US005094227A

United States Patent [19]

Eglauf et al.

[11] Patent Number: 5,094,227

[45] Date of Patent: Mar. 10, 1992

[54] NON-INVASIVE PAIN RELIEF APPARATUS

[75] Inventors: Douglas R. Eglauf, 24 Carhart Ave., #319, White Plains, N.Y. 10605; Joseph Panio, Milton, N.Y.; George Schick, Easton, Conn.

[73] Assignee: Douglas R. Eglauf, White Plains, N.Y.

[21] Appl. No.: 522,111

[22] Filed: May 11, 1990

[51] Int. Cl.[5] ..... A61H 7/00; A61H 39/04

[52] U.S. Cl. ..... 128/60; 606/204

[58] Field of Search ..... 128/32, 59, 60; 606/189, 204

[56] References Cited

U.S. PATENT DOCUMENTS 4,320,760 3/1982 Sun et al. ..... 606/204

4,466,437 8/1984 Dyck et al. ..... 128/327

4,479,495 10/1984 Isaacson ..... 606/204

4,549,536 10/1985 Varjabedian ..... 128/60

4,716,898 1/1988 Cheuve et al. ..... 606/204

*Primary Examiner*—Edgar S. Burr

*Assistant Examiner*—Moshe I. Cohen

[57] ABSTRACT

The present invention is directed to a medical device which mechanically applies and maintains pressure to a pressure point to relieve pain. The device includes a locking mechanism to lock an adjustable clamp to a selected position to apply a selected amount of pressure and a fine tuning mechanism to precisely adjust the amount of pressure. A mechanical release and a safety device are also provided to release pressure if the exerted pressure exceeds a safe amount.

19 Claims, 2 Drawing Sheets

NON-INVASIVE PAIN RELIEF APPARATUS

BACKGROUND OF THE INVENTION

This invention relates to the ancient science of acupuncture/acupressure (finger pressure) and in particular relates to a non-invasive mechanical device for application of ancient Chinese principles over at least one specific documented Acupuncture/Acupressure point as an effective alternative for symptomatic treatment of pain such as Muscle-Contraction Headaches.

The true field of Acupuncture treatment is that of impaired body function as opposed to actual lesions. One of the primary functions of Acupuncture is to effect directly the energy level, and therefore the functioning of the internal organs by either stimulating or depressing their action. (The Laymen's Guide of Acupuncture, Yoshio Monaka, M.D., Ian A. Urquhari, Ph.D.).

There are many theories to explain the physiological functions of acupuncture/acupressure in the basic mechanism of pain. One is the "Chinese Meridian" (pathway) theory where perhaps acupressure stimulates nerve endings with the release of pain killing endorphins. Another is the "Gate Control Theory" by R. Melzack, Ph.D. and P. D. Wall Science Magazine (150:1965), whereby sensor stimulation (acupressure) sends pleasurable impulses to the brain at a rate four times faster than painful stimuli. These impulses shut the neural "GATES" so that the slower messages of pain are blocked from reaching the brain. This "Counter Stimulation" overloads the neurons in the spinal cord, thereby preventing the perception of pain.

Robert O. Becher, M.D., Orthopedist, Upstate Medical Center, Syracuse, N.Y. found that stimulation of a site on the body proper (i.e., ear, hand), converts a message into a nerve impulse that is transmitted to the brain. This "COUNTERSTIMULATION" message finally reaches the pituitary gland and promotes it to release enkephalins and endorphins. These neural opiate-like pain killing peptides block the perception of pain. Widespread clinical material dating from ancient times testifies to the effectiveness of kneading or pressing certain points on the body in stopping pain.

Yoshio Monaka, M.D., and Ian A. Urquhari, Ph.D., (The Layman's Guide to Acupuncture, Publisher John Weatherhill, Inc., Madison Avenue, N.Y.) lists a number of disorders according to their degree of responsiveness. HEADACHES are listed under Group A in which acupuncture/acupressure is considered to be very effective. Muscle contractures, no matter how chronic, are most always quickly relieved. Statistics indicate success in 90% of cases involving pain treated by acupuncture/acupressure.

There are some 500 to 800 acupuncture points or spots as shown by various Chinese and Japanese charts. Exactly 669 points are listed in Dr. Chu Lien's HSIN CHEN CHIU HSUEH (Modern Acupuncture), a standard text used in present day China.

The School of traditional Medicine, Peking, China compiled a list of eleven (11) acupuncture points for the treatment of headache (Acupuncture Made Easy-Acupuncture Research Institute, Los Angeles, Calif., Publication, Chan's Books and Product, Alhombra, Calif. p. 59).

The Ho Ku Point (Large Intestine 4) of Acupuncture can be used for treatment of pain related to Muscle-Contraction Headaches. This classification of headache, as defined by Journal of the American Medical Association (179:717, 1962) under Classification of Headaches, is found to be "Ache or sensations of tightness, pressure, or constriction, widely varied in intensity, frequency and duration, sometimes long lasting, and commonly sub-occipital. It is associated with sustained contraction of skeletal muscles in the absence of permanent structural change, usually as part of the individual's reaction during life stress. The ambiguous terms "tension" "psychogenic" and "nervous" headache refer to this group."

In the prior art, it was necessary for someone to manually apply and maintain pressure to this point for a period of time, either by hand or with a device such as the one described in U.S. Pat. No. 4,549,536 issued to Varjabedian on Oct. 29, 1985. However, the device in that patent has several drawbacks. First of all, the prior art device requires that someone must continually apply pressure since the device is spring loaded to force it open. There is no disclosure of providing a locking mechanism to apply a constant amount of pressure or for maintaining pressure without manually doing so. Nor is there any way to fine tune the amount of pressure applied.

SUMMARY OF THE INVENTION

Accordingly, it is the object of the present invention to overcome these and other drawbacks of the prior art and to provide a medical device capable of applying and maintaining pressure in a mechanical way which is simple, harmless and effective.

It is another object of the present invention to provide a medical device that can lock into position so that constant pressure may be applied and where fine tuning of the amount of pressure may be effected.

DETAILED DESCRIPTION

The present invention is directed generally to a mechanical apparatus for applying pressure to an acupuncture/acupressure point to relieve certain pain. One such point is found on the hand and is known as the Ho Ku Point. This point is effective for relieving certain types of pain such as muscle-contraction headaches. The principles of this device can be used on other parts of the body for relief of other pains as well.

Figure 1:
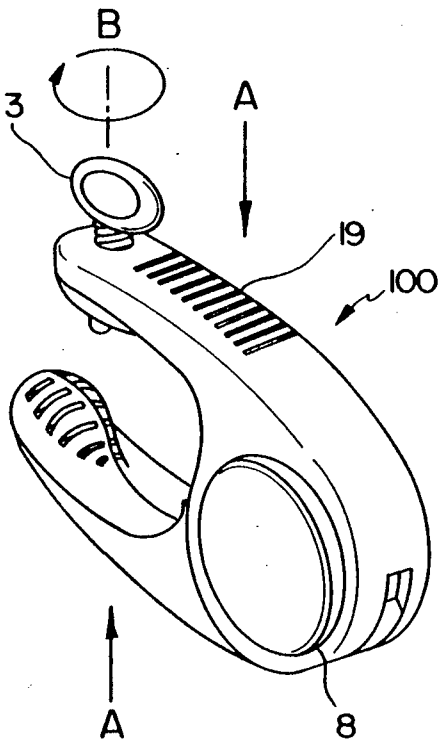
FIG. 1 is an overall perspective of the present invention.
Figure 2:
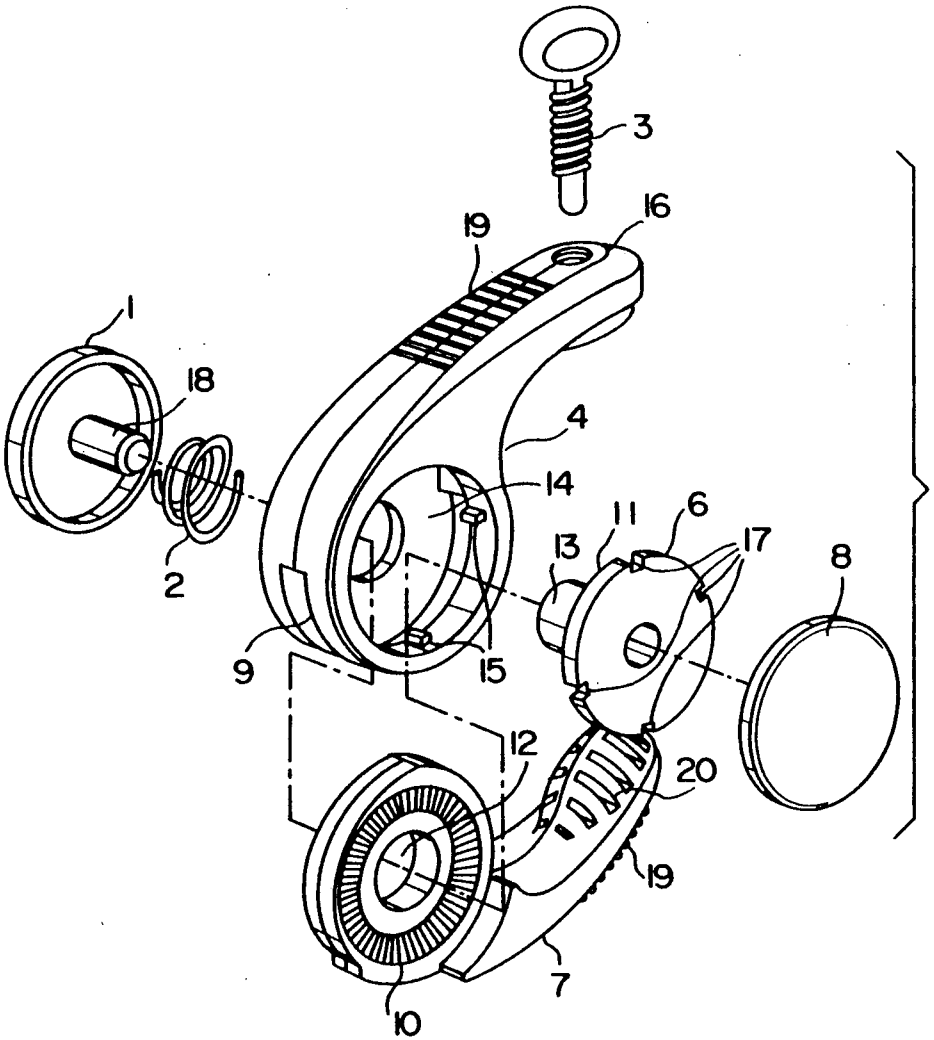
FIG. 2 is an exploded view of the present invention.

According to a preferred embodiment, described in connection with FIGS. 1 and 2, there is disclosed a mechanical aparatus capable of achieving the objects of the present invention.

The device comprises a clamp, generally indicated as 100, having an upper part 4 and a lower part 7. The upper part has a groove 9 for receiving the lower part and a threaded hole 16 for receiving a screw 3. In the lower part 7 there are formed ratchet teeth 10. These teeth interact with teeth 11 formed in a ratchet locking disc 6 to allow the clamp to be closed to a certain position and "locked" at that position. The upper part 4 has an opening 14 formed therethrough having a first diameter on one side and a second diameter, preferably smaller than the first diameter, on the opposing side.

The ratchet teeth 10 of the lower part of the clamp are preferably formed in a circular pattern concentric with opening 12 formed in the central portion of the lower part 7. A protruding portion 13 of ratchet locking disc 6 is inserted through opening 12 to engage ratchet teeth with ratchet teeth 10.

When assembled, the lower part 7 is inserted through the groove 9 of upper part 4 and the protruding portion 13 of locking disc 6 is inserted through openings 12 and 14 of the lower and upper parts, respectively.

At the periphery of locking disc 6, a plurality of cutouts 17 are formed. These cutouts engage a plurality of projections 15 formed at an inner portion of opening 14 of upper part 4 to hold locking disc 6 in place and, in combination with ratchet teeth 10 and 11, lock the clamp at a fixed position. It is to be understood that this fixed position can be changed by further squeezing the upper and/or lower portions of the clamp to "lock" the clamp at a new position (decreasing the opening of the clamp) or by using the release mechanism 1 to release pressure (increasing the opening of the clamp).

At the other side of the clamp there is provided a conical spring 2 and a release mechanism 1 which may be in the form of a button. Release mechanism 1 is pressed into locking disc 6 and cemented or otherwise fixedly secured thereto. Preferably, protruding portion 13 of disc 6 has an opening formed therein for receiving protruding portion 18 of release mechanism 1. When operatively positioned, activating release mechanism 1 causes teeth 11 of disc 6 to disengage the teeth 10 of lower part 7 thereby unlocking the clamp and allowing the clamp to be opened and pressure to be released.

According to another novel aspect of the present invention, there is also provided a fine tuning mechanism preferably in the form of a threaded element such as screw 3, though other mechanisms for achieving the same function will be readily apparent to one of ordinary skill in the art. This element is used to fine tune the amount of pressure applied to the pressure point, i.e. increasing or decreasing the amount of pressure, by screwing or unscrewing the screw.

Figure 3:
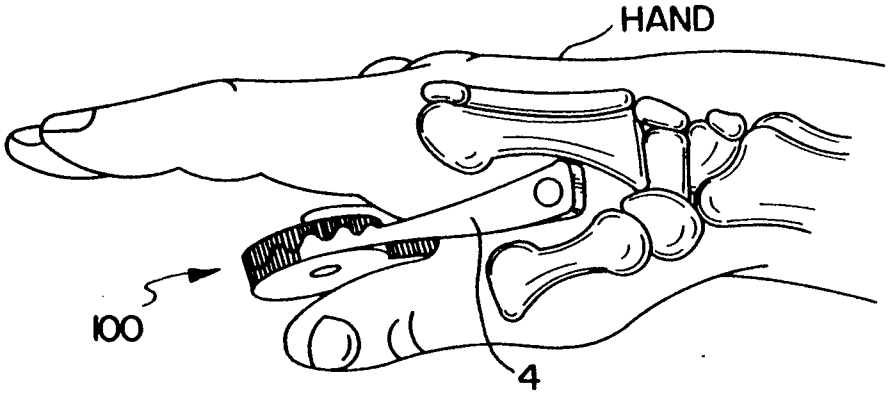
FIG. 3 is a perspective of the present invention positioned on a hand.

In operation, a coarse tuning is effected by squeezing the device together at points A (FIG. 1), so that ratchet teeth 10 and 11 are engaged, forming a clamp at the pressure points on the hand as shown in FIG. 3. The device "locks" at this position due to the engagement of ratchet teeth 10 and 11 and the fixed position of disc 6 due to the cooperation of cutouts 17 and projections 15 and since spring 2 and release mechanism 1 (attached to locking disc 6) keep a constant pressure against lower part 7 thereby maintaining teeth 10 and 11 in engagement. Final adjustment is made by using fine tuning mechanism 3, e.g., by twisting screw 3 to fine tune the amount of pressure applied. To release pressure, screw 3 can be unscrewed and/or the push-button (1) can be depressed thereby pushing disc 6 away from lower part 7 thereby disengaging teeth 10 and 11 to release the jaw openings and relieving pressure from the pressure point.

The coil spring 2 is preferably a plated piano wire spring made of chrome. A stainless steel spring may be preferred if the device is to be carried around in a pocket or sweaty environment. Due to space limitations, the spring is preferably conical and as it is depressed, it collapses inside itself. However, other types of springs may be used.

On upper part 4, the projections 15 are used as guides for the locking disc 6, and to keep the clutch plate from slipping. Furthermore, these projections in conjunction with cutouts 17 serve as a safety mechanism. According to one embodiment, these projections have a thickness that will cause them to shear off at a certain pressure thereby providing a measure of safety to the acupressure device, so that it can't be squeezed so tight that it will injure someone. That is, if the clamp were closed to a point such that an amount of pressure were exerted that could cause harm (e.g., greater than thirty pounds of pressure), these projections could be designed to shear off to automatically release the pressure and avoid injury.

According to another embodiment, these projections could be formed with an angled surface (not shown) such that if excessive pressure were exerted, the locking disc could be allowed to ride up on these angled projections and slip over them so that pressure would be released. This embodiment prevents destruction of the device.

There may also be provided on the upper and lower parts, a non-slip surface (19) where the thumb and fingers are to be applied to squeeze the device together. On the lower part, there may also be provided relief sections (20) which tend to provide a grip area in the palm of the hand or upper part of the hand, in whichever way it is applied, thereby providing a non-slip type of surface.

The screw adjustment 3 preferably has a full adjustment down of about $\frac{1}{4}''$, which is generally sufficient because most of the pressure can be taken up by squeezing the clamp together in the coarse tuning part. Then, the final pressure (fine tuning) is applied with screw 3, or whatever mechanism is provided for fine tuning to precisely control the amount of pressure.

The overall shape and design of the clamp may vary, but preferably the upper and lower parts provide at least a sufficient contact area with the palm or the upper part of the hand to apply the amount of pressure needed.

Cover 8 may be provided to cover disc 6 and keep disc 6 within opening 14.

Of course, the release mechanism need not be a button as shown in the preferred embodiment. A release lever or the like could be provided. Various alternative mechanisms will be readily apparent to one of ordinary skill in the art.

Moreover, other types of safety release mechanisms may be envisioned in lieu of projections 15 and cutouts 17.

What has been disclosed are the preferred embodiments of the present invention. Various modifications may be made within the scope of the invention. The invention is only limited by the claims appended hereto.

We claim:

1. A medical device for relieving pain comprising:

an adjustable clamp having a contact area capable of applying pressure in a direction to an acupressure point;

course adjustment means for providing a coarse adjustment of the amount of pressure applied by said clamp to said point; and fine adjustment means including means for moving said contact area relative to said clamp in said direction for providing a fine adjustment of the amount of pressure applied by said clamp to said point.

2. The device of claim 1 wherein said coarse adjustment means comprises pivot means for closing said clamp.

3. The device of claim 1 wherein said fine adjustment means comprises a screw-type device.

4. The device of claim 1 wherein said coarse adjustment means comprises pivot means for closing said clamp and said fine adjustment means comprises a screw-type device.

5. A medical device for relieving pain comprising:

an adjustable clamp having a contact area, said clamp being capable of clamping said device to an acupressure point to apply pressure to said point in a direction;

a course adjustment mechanism capable of providing a coarse adjustment of said clamp to a position that provides a selected amount of pressure to said point;

a locking mechanism capable of mechanically locking said clamp at said selected position to substantially maintain said selected pressure on said point; and a fine adjustment mechanism including means for moving said contact area relative to said clamp in said direction to provide a fine adjustment of the amount of pressure applied to said point.

6. The device of claim 5 wherein said coarse adjustment means comprises pivot means for closing said clamp.

7. The device of claim 5 wherein said fine adjustment mechanism comprises a screw-type device.

8. The device of claim 5 wherein said coarse adjustment mechanism comprises pivot means for closing said clamp and said fine adjustment mechanism comprises a screw-type device.

9. The device of claim 5 wherein said locking mechanism comprises a ratchet mechanism.

10. The device of any one of claims 1 or 5 further comprising a release mechanism for selectively releasing a portion of the amount of pressure applied to said point.

11. The device of any one of claims 1 or 5 further comprising a safety mechanism for automatically decreasing the amount of pressure applied to said point to prevent excessive pressure from being applied to said point.

12. The device of any one of claims 1 or 5 wherein said point is located on a hand.

13. The device of any one of claims 1 or 5 wherein said point is the Ho Ku Point.

14. The device of any one of claims 1 or 5 further comprising safety means for preventing excessive pressure from being applied to said point.

15. The device of claim 14 wherein said clamp comprises an opening defined by an opening surface and wherein said safety means comprises projections formed on said opening surface and further comprises a disc having cutouts formed thereon.

16. The device of claim 15 wherein said projections have a substantially rectangular configuration.

17. The device of claim 16 wherein said projections have an angled surface to allow slippage of said disc.

18. The device of claim 16 wherein said projections are designed to shear off from said opening surface if the amount of pressure on said point exceeds a predetermined amount of pressure.

19. The device of claim 17 wherein said disc comprises a portion of said ratchet mechanism.

* * * * *